United States Patent [19]

Fridlyander et al.

[11] 3,960,551

[45] June 1, 1976

[54] ALUMINIUM BASED ALLOY

[76] Inventors: Iosif Naumovich Fridlyander, Volokolamskoe shosse, 15/22, kv. 66, Moscow; Konstantin Petrovich Yatsenko, 15 Parkovaya ulitsa, 44, kv. 47, Moscow; Galina Anatolievna Nekrasova, 1 Mosfilmovsky pereulok, 14, kv. 76, Moscow; Alexandr Nikolaevich Gulin, Belovezhskaya ulitsa, 31, kv. 32, Moscow; Zoya Grigorievna Semenova, B. Cherkizovskaya ulitsa, 5, korpus 4, kv. 8, Moscow; Nikolai Grigorievich Sidorov, prospekt Koroleva, 1, kv. 150, Kaliningrad Moskovskoi oblasti; Boris Sergeevich Morozov, ulitsa Tikhomirova, 1, kv. 12, Moscow; Efrem Julievich Krichevsky, ulitsa Borisa Galushkina, 17, kv. 280, Moscow; Tatyana Alexandrovna Zakharova, Shmitovsky Proezd, 13, kv. 34, Moscow; Raisa Grigorievna Sarycheva, B. Cherkizovskaya ulitsa, 8, korpus 11, kv. 70, Moscow, all of U.S.S.R.

[22] Filed: Oct. 21, 1974

[21] Appl. No.: 516,874

[52] U.S. Cl. ..... 75/147; 148/32

[51] Int. Cl.[2] ..... C22C 21/06

[58] Field of Search ..... 75/147; 148/32, 32.5

[56] References Cited

UNITED STATES PATENTS 1,952,049 3/1934 Archer et al. ..... 75/147

*Primary Examiner*—R. Dean

*Attorney, Agent, or Firm*—Haseltine, Lake & Waters

[57] ABSTRACT

An aluminium-based alloy comprising between 9.5 and 30.0 wt % of beryllium, between 0.5 and 10.0 wt % of magnesium, between 0.05 and 0.5 wt % of titanium, between 0.05 and 0.5 wt % of zirconium, the balance being aluminium.

1 Claim, No Drawings

ALUMINIUM BASED ALLOY

The present invention relates to aluminium-based alloys which may find application in aircraft engineering and in the manufacture of other rigid structures where light weight in combination with rigidity and adequate strength under temperatures of around 300°C are the primary requirements.

The aluminium-based alloy disclosed comes under the category of what may be called deforming alloys, it displays a comparatively low weight and suitable rigidity. The all-best efficiency is obtained when this alloy is used in thin-walled rigid structures where savings in weight amounting to between 20 and 40% is a factor of para-mount importance.

There is known a deforming alloy containing between 24 and 43 wt% of aluminium along with some 57 to 76% of beryllium. This is a beryllium-rich alloy exhibiting high modulus of elasticity. Yet, this alloy displays low ductility while being worked which is inferior to the ductility of other known aluminium-based alloys and this limits the scope of its application.

There is also known a deforming aluminium-based alloy doped with magnesium and containing beryllium in an amount between 30 and 50 wt %. The high beryllium content, which is 30 wt % and upwards, gives the known alluminium-based alloy high rigidity but the fact that beryllium is a low-ductility metal with hexagonal lattice structure characterized by an unfavourable relationship between its parameters poses a number of manufacturing problems when the known alloy is used as the material for thin and rigid aircraft skin. Although this latter alloy contains beryllium less than the former, it also displays a lower ductility when being worked than other known aluminium-based alloys and for this reason also finds a limited scope of application.

Aluminium-based alloys displaying high ductility when being worked are indispensable in the manufacture of aircraft components such as thin-section wings, for example. The production of some components, including structural members of the wing, involves bending and stamping. This, in its turn, calls for an improvement in the properties of the alloy, the ductility before all by diminishing the grain size of structure, achieveable through the selection of the right components of the alloy. In addition, the alloy for the manufacture of said aircraft components must assure resistance to the overloads coming on these components, display light weight and high strength.

At present there are no alloys meeting all these requirements simultaneously.

It is the main object of the present invention to provide an aluminium-based alloy which is of such composition and the components are taken in such amounts that improved ductility of the alloy is obtained when this is being worked.

Another object of the present invention, which is of no less importance, is to provide an alloy displaying a sufficiently high modulus of elasticity combined with low density.

A further object of the present invention is to assure the requisite strength of the alloy.

Said and other objects are attained by providing an aluminium-based alloy composed of beryllium and magnesium wherein included according to the invention over and above said components taken in an amount of 9.5 to 30.0 wt % of beryllium and 0.5 to 10.0 wt % of magnesium are also 0.05 to 0.5 wt % of titanium and 0.05 to 0.5 wt % of zirconium, the balance being aluminium.

The alloy disclosed containing beryllium in an amount of up to 30 wt % exhibits an increase in the ductility when being worked which property is of importance when the bending to a short radius or the extrusion of blanks are involved in the manufacture of components.

It has been discovered that a reduction of the beryllium content of aluminium-based alloy from 30.0 to 9.5 wt % paves the way to providing an alloy suitable for the fabrication of more intricately-shaped components exhibiting a rigidity which is half as much again to twice that of the known aluminium-based alloys.

Said combination of properties in the alloy disclosed is achieved by using a mechanical mixture of aluminium and beryllium doped with magnesium, titanium and zirconium as the starting material whereas in the known alloys the starting material is a solid solution which is a common practice in the production of high-strength alloys.

The introduction of the magnesium in said amount and ratio with chemically-active metals, such as titanium and zirconium, assures the formation of a homogenous fine-grained structure which facilitates the shaping of the alloy in the case of fabricating various components and adds to the ductility of the alloy when this is being worked.

The present invention will be best understood from the following examples giving possible compositions of the alloy.

EXAMPLE 1

An alloy comprising 29.0 wt % of beryllium, 0.5 wt % of magnesium, 0.05 wt % of titanium, 0.05 wt % of zirconium, the balance being aluminium, was prepared by melting a charge and casting the melt into ingots under a blanket of inert gas, using vacuum induction furnaces. Fabricated from ingots were rods, strips, shapes and other semi-finished products along with plate of various thickness, the process of hot forming being accomplished at a temperature of 400° to 420°C.

The alloy produced needed no additional heat treatment and was practically not susceptible to heating. Neither the mechanical properties nor structure of the alloy were affected by protracted heating.

The mechanical properties of the alloy produced were as follows:

$\sigma_B = 40–42$ kg/mm²; $\delta = 20–30\%$;
$\psi = 25–35\%$; $E = 13500$ kg/mm²;
$\gamma = 2.35$ g/cm³.

where $\phi_B$ = ultimate strength;
$\psi$ = contraction of area;
$\delta$ = elongation at break;
$E$ = modulus of elasticity;
$\gamma$ = specific gravity.

EXAMPLE 2

An alloy comprising 29.0 wt % of beryllium, 5.0 wt % of magnesium, 0.05 wt % of titanium, 0.05 wt % of zirconium, the balance being aluminium, was prepared and formed in the same way as indicated in Example I.

The mechanical properties of the alloy produced were as follows:

$\sigma_B = 42–48$ kg/mm²; $\delta = 20–25\%$;
$\psi = 30–40\%$; $E = 13500$ kg/mm²;
$\gamma = 2.35$ g/cm³.

EXAMPLE 3

An alloy comprising 20.0 wt % of beryllium, 7.5 wt % of magnesium, 0.1 wt % of titanium, 0.1 wt % of zirconium, the balance being aluminium, was prepared and formed in the same way as indicated in Example I.

The mechanical properties of the alloy produced were as follows:

$\sigma_B = 42–48$ kg/mm²; $\delta = 20–34\%$;
$\psi = 40–50\%$; $E = 11500$ kg/mm²;
$\gamma = 2.4$ g/cm³.

EXAMPLE 4

An alloy comprising 10.0 wt % of beryllium, 10.0 wt % of magnesium, 0.5 wt % of titanium, 0.5 wt % of zirconium, the balance being aluminium, was prepared and formed in the same way as indicated in Example I.

The mechanical properties of the alloy produced were as follows:

$\sigma_B = 43–47$ kg/mm²; $\delta = 25–35\%$;
$\psi = 45–50\%$; $E = 10000$ kg/mm²
$\gamma = 2.45$ g/cm³

It will be noted that in Example 4 the beryllium content of the alloy produced was reduced to 10.0 wt % and the content of both aluminium and magnesium was increased. This has lead to an improved ductility of the alloy when this is being worked, said ductility being characterized by such factors as impact strength, sensitivity to notching and stress concentrations (cracks, scratches).

Beryllium is a metal exhibiting low impact strength and high sensitivity to sharp-edged notches and stress concentrations. The alloy owes its high modulus of elasticity, i.e., rigidity, to the beryllium phase present in the structure whereas high strength and heat resistance are obtained due to the presence of beryllium phase and doping additives, such as magnesium, titanium and zirconium which reinforce the aluminium phase.

From the standpoint of structure, aluminium-beryllium alloys come under the category of composite materials wherein soft ductile base (aluminium phase) is reinforced with beryllium in the form of fiber or flakes depending on the kind of the blank and the technique of its production. High ductility of the aluminium phase is the factor assuring satisfactory ductility of the alloy when this is being worked and satisfactory impact strength.

By selecting the right components and taking them in amounts assuring the right ratio, an alloy exhibiting high modulus of elasticity, low specific gravity, high strength and adequate ductility when being worked has become a practical possibility. The alloy disclosed features mechanical properties (strength, ductility, modulus of elasticity and density) of an order which exceeds the same properties of the known alloys produced both in the USSR and other countries.

The alloy disclosed is suitable for the fabrication of components where light weight and rigidity are the main criterions, as ailerons, rudders, elevators and skin of cylindrical shells by way of illustration. Said alloy may also find application as the material of expendable components exposed to temperatures of up to 400°C or those which operate continuously at temperatures not over 260°C without being subject to a continuous single load.

The use of aluminium-based alloy containing beryllium in an amount between 9.5 and 30.0 wt % will substantially simplify the problem of manufacturing intricately-shaped components, assuring at the same time a rigidity as high as half as much again to twice that of the known aluminium-based alloys.

Tests have proved that the alloy produced in accordance with the invention compares favourably in terms of ductility with similar known alloys used in aircraft engineering.

The alloy disclosed may be used as the sole material of a structure, all its components being made of same, or said alloy may be used for the manufacture of only some of the components of the structure, the rest being in any of the known industrial aluminium-based alloys.

What is claimed is:

1. An alloy consisting essentially of between 9.5 and 30 wt % of beryllium, between 0.5 and 10.0 wt % of magnesium, between 0.05 and 0.5 wt % of titanium, between 0.05 and 0.5 wt % of zirconium, the balance being aluminium.

* * * * *